US006615561B2

(12) United States Patent
MacDonald et al.

(10) Patent No.: US 6,615,561 B2
(45) Date of Patent: Sep. 9, 2003

(54) RETAINING WALL BLOCK

(75) Inventors: Robert A. MacDonald, Plymouth, MN (US); Robert J. Race, Eagan, MN (US)

(73) Assignee: Keystone Retaining Wall Systems, Inc., Bloomington, MN (US)

( * ) Notice: Subject to any disclaimer, the term of this patent is extended or adjusted under 35 U.S.C. 154(b) by 0 days.

(21) Appl. No.: 09/876,654

(22) Filed: Jun. 7, 2001

(65) Prior Publication Data

US 2002/0187010 A1 Dec. 12, 2002

(51) Int. Cl.[7] ..... E04B 5/04
(52) U.S. Cl. ..... 52/606; 52/608; D25/113
(58) Field of Search ..... 52/606, 608; 405/284; D25/113

(56) References Cited

U.S. PATENT DOCUMENTS

| | | | | |
|---|---|---|---|---|
| 4,123,881 A | * | 11/1978 | Muse | 52/98 |
| 4,914,876 A | | 4/1990 | Forsberg | |
| 4,920,712 A | | 5/1990 | Dean, Jr. | |
| 5,044,834 A | | 9/1991 | Janopaul, Jr. | |
| RE34,314 E | | 7/1993 | Forsberg | |
| 5,267,816 A | | 12/1993 | Mercer et al. | |
| 5,294,216 A | | 3/1994 | Sievert | |
| 5,417,523 A | | 5/1995 | Scales | |
| 5,551,809 A | * | 9/1996 | Frosberg | 405/284 |
| 5,560,172 A | | 10/1996 | Brophy et al. | |
| 5,623,797 A | * | 4/1997 | Gravier et al. | 52/606 |
| 5,911,539 A | | 6/1999 | Egan et al. | |
| 5,913,790 A | | 6/1999 | Dawson | |
| 5,941,042 A | | 8/1999 | Dueck | |
| 5,951,210 A | * | 9/1999 | Maguire et al. | 405/284 |
| 6,035,599 A | * | 3/2000 | Sonnentag | 52/606 |
| 6,062,772 A | | 5/2000 | Perkins | |
| 6,195,955 B1 | * | 3/2001 | Kostopoulos | 52/741.13 |

FOREIGN PATENT DOCUMENTS

| | | |
|---|---|---|
| WO | WO 97/44533 | 11/1997 |
| WO | WO 00/22243 | 4/2000 |

* cited by examiner

*Primary Examiner*—Carl D. Friedman
*Assistant Examiner*—Nahid Amiri
(74) *Attorney, Agent, or Firm*—Popovich & Wiles, P.A.

(57) ABSTRACT

A retaining wall block is provided with a core, pin receiving cavities, and pin holes. The pin receiving cavities and pin holes are arranged on the block symmetrically on the block and substantially outside of block corner segments, thus resulting in a stronger block and permitting optimal alignment of the wall block cores when constructing a retaining wall. Retaining walls made using the block have increased strength.

21 Claims, 13 Drawing Sheets

RETAINING WALL BLOCK

FIELD OF THE INVENTION

The present invention relates to retaining wall blocks and walls made from such blocks. In particular, this invention relates to retaining wall blocks having pin receiving cavities, pin holes, and cores arranged to maximize the strength of the block and walls made therefrom.

BACKGROUND OF THE INVENTION

Numerous methods and materials exist for the construction of retaining walls. Such methods include the use of natural stone, poured in-place concrete, pre-cast concrete, masonry, and landscape timbers or railroad ties. In recent years, segmental concrete retaining wall units which are dry stacked (i.e., built without the use of mortar) have become a widely accepted product for the construction of retaining walls. Examples of such products are described in U.S. Pat. No. Re. 34,314 (Forsberg '314) and U.S. Pat. No. 5,294,216 (Sievert). Such products have gained popularity because they are mass produced, and thus relatively inexpensive. They are structurally sound, easy and relatively inexpensive to install, and couple the durability of concrete with the attractiveness of various architectural finishes.

The retaining wall system described in Forsberg '314 has been particularly successful because of its use of block design that includes, among other design elements, a unique pinning system that interlocks and aligns the retaining wall units, allowing structural strength and efficient rates of installation. This system has also shown considerable advantages in the construction of larger walls when combined with the use of geogrid tie-backs hooked over the pins, as described in U.S. Pat. No. 4,914,876 (Forsberg).

The construction of modular concrete retaining walls as described in Forsberg involves several relatively simple steps. First, a leveling pad of dense base material or unreinforced concrete is placed, compacted and leveled. Second, the initial course of blocks is placed and leveled. Two pins are placed in each block into the pin holes. Third, core fill material, such as crushed rock, is placed in the cores of the blocks and spaces between the blocks to encourage drainage and add mass to the wall structure. Fourth, succeeding courses of the blocks are placed in a "running bond" pattern such that each block is placed between the two blocks below it. This is done by placing the blocks so that the receiving cavities of the bottom of the block fit over the pins that have been placed in the units in the course below. As each course is placed, pins are placed in the blocks, the blocks are corefilled with drainage rock, and the area behind the course is backfilled and compacted until the wall reaches the desired height.

If wall height or loading conditions require it, the wall structure may be constructed using reinforced earth techniques such as geogrid reinforcement, geosynthetic reinforcement, or the use of inextensible materials such as steel mesh or mat. The use of geogrids are described in U.S. Pat. No. 4,914,876 (Forsberg). After placement of a course of blocks to the desired height, the geogrid material is placed so that the pins in the block penetrate the apertures of the geogrid. The geogrid is then laid back into the area behind the wall and put under tension by pulling back and staking the geogrid. Backfill is placed and compacted over the geogrid, and the construction sequence continues as described above until another layer of geogrid is called for in the planned design. The use of core fill in the blocks is known to enhance the wall system's resistance to pull out of the geogrid from the wall blocks.

Block designs known in the art have typically not maximized the amount of core fill in a retaining wall because the block shape and core design do not permit this. Use of maximum amount of core fill was thought to be a way to strengthen a retaining wall and minimize problems with geogrid pull out. A block designed to maximize the amount of core fill due to alignment of blocks in a wall, whether the blocks are in a running bond pattern or stacked directly on top of and aligned with each other is described in commonly assigned, co-pending U.S. patent application Ser. No. 09/312,352 (filed May 14, 1999) entitled "Retaining Wall Block". The blocks have a core, pin receiving cavities and pin holes. The pin receiving cavities are on the bottom of the blocks and engage pins placed in the pin holes of a block on a lower course of blocks in a wall. The pin receiving cavities extend approximately one inch into the bottom surface of the blocks and do not extend through the thickness of the block from bottom to top. The arrangement of the pin holes and pin receiving cavities in a plane parallel to a plane of symmetry permits formation of walls with predetermined set back, ease of construction, good alignment of cores and improved strength due to core-filling. These blocks are typically manufactured, loaded onto pallets and shipped with the pin receiving cavities facing up. Therefore, when a retaining wall is assembled with these blocks they must be flipped over by the installer so that the bottom of the block faces downward.

However, it is desirable to facilitate construction methods of retaining walls as well as to optimize the strength of retaining wall blocks. Improved strength is an advantage not only during construction of retaining walls but during manufacture of the block.

SUMMARY OF THE INVENTION

It has been discovered that pin holes and pin receiving cavities can be arranged on a block to result in a stronger block and a stronger wall made from such blocks. The pin receiving cavities penetrate the thickness of the block, providing for easier construction of a wall as well as reduced weight for the block.

In one aspect, this invention is a retaining wall block comprising a top surface; a bottom surface substantially parallel to the top surface; first and second side surfaces; a front face; and a rear face; the front and rear faces, top and bottom surfaces and side surfaces defining a body portion including the front face, a head portion including the rear face, and a neck portion connecting the body portion and the head portion, the neck portion including a first portion of the first side surface and a first portion of the second side surface, the first portion of the first side surface lying substantially within a first plane, the first portion of the second side surface lying substantially within a second plane, the neck portion being configured such that intersections of the first and second planes with the body portion define first and second corner portions of the body portion, the body portion including first and second pin holes opening into the top surface and first and second pin receiving cavities extending through the body portion and opening into the top surface and the bottom surface, the pin receiving cavities being positioned such that no substantial portion of the cavities lies within the first and second corner portions.

The neck portion may include an opening extending through the neck portion from the top surface to the bottom surface, the opening dividing the neck portion into first and second neck wall members extending rearwardly from the body portion to the head portion. The body portion may also comprise third and fourth pin holes opening onto the top surface. The side wall faces may taper from the front face to the rear face. The head portion may have first and second ears extending laterally beyond the first and second neck wall members, respectively, the first and second ears each being provided with a notch to enable the ears to be knocked off the head portion.

In a second embodiment, this invention is a retaining wall comprising at least one lower course and at least one upper course, each course comprising a plurality of blocks laid in a running bond pattern, and comprising the block described above. First and second pins are disposed in the first and second pin holes, respectively, of a block in the lower course, the first pin having a first free end protruding beyond the top face of the block, the second pin having a second free end protruding beyond the top face of the block, the first free end being received in a pin receiving cavity of a first block in the upper course, the second free end being received in a pin receiving cavity of a second block in the upper course, and a continuous cavity is defined by each opening of vertically aligned blocks in the upper course of the blocks communicating with side voids of vertically adjacent blocks in the lower course.

The wall may be straight, curved, or serpentine and may further comprise rebar and grout, wherein a length of the rebar passes through the continuous cavity and is secured with the grout. The wall may also comprise at least one post extending into the continuous cavity and protruding from the upper course, the at least one post being secured in the cavity with grout and/or a geogrid tie-back disposed between the upper and lower courses, the geogrid tie-back having apertures and being secured with at least one of the first and second pins passing through the apertures thereof. The retaining wall may also include a pilaster formed of a column of the blocks set forward from the remainder of the wall.

BRIEF DESCRIPTION OF THE DRAWINGS

A preferred form of the present invention will now be described by way of example with reference to the accompanying drawings, wherein.

DETAILED DESCRIPTION OF THE PREFERRED EMBODIMENTS

In this application, "upper" and "lower" refer to the placement of the block in a retaining wall. The lower surface faces down, that is, it is placed such that it faces the ground. In forming a retaining wall, one row of blocks is laid down, forming a course. A second course is laid on top of this by positioning the lower surface of one block on the upper surface of another block.

The Figures describe various block embodiments. Many elements in various block embodiments are identical in shape, size, relative placement, and function, and therefore the numbers for these elements do not change. Elements that vary from one block embodiment to another are denoted by suffices "a", "b", "c", "d", "e", and "f" and may be referred to in a general way by a number without its suffix.

The blocks of this invention are symmetrical about a vertical plane of symmetry. The blocks are provided with pin holes, pin receiving cavities, and at least one core which serve to decrease the weight of the block while maintaining its strength while also providing ease of construction of a retaining wall. The location, shape, and size of the pin holes and pin receiving cavities are selected to maximize the strength of the block, as described by reference to the drawings.

Figure 1:
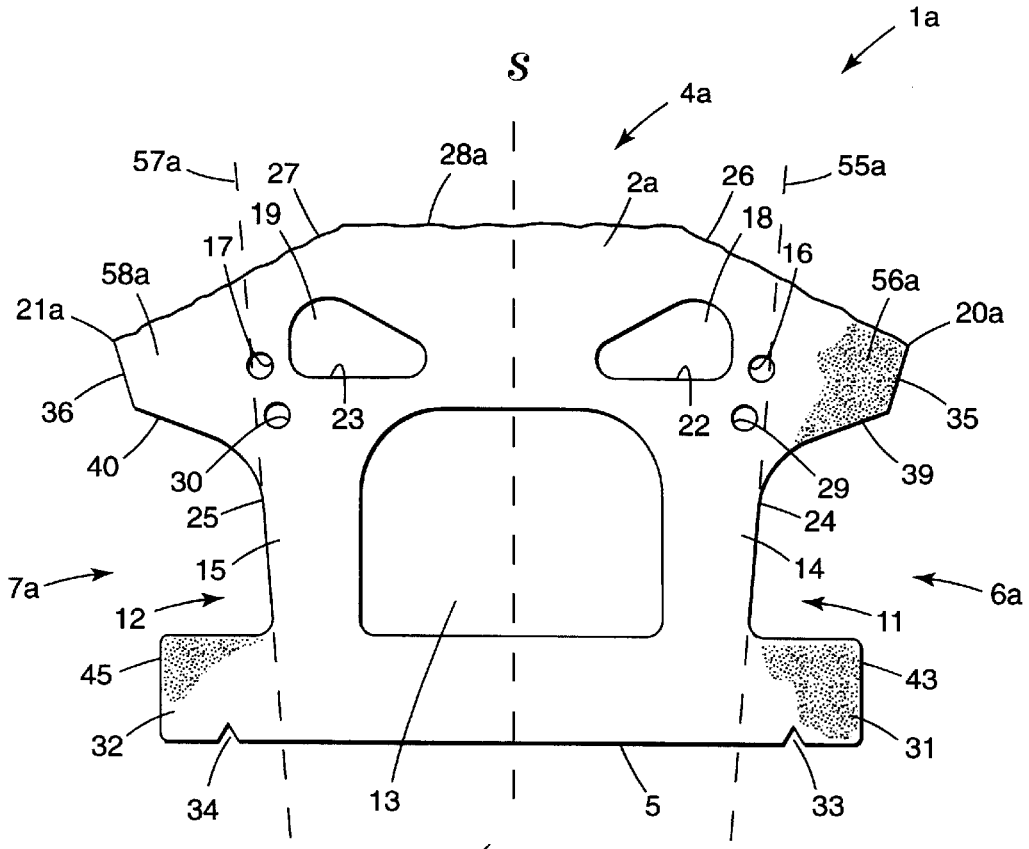
FIG. 1 is a top view of one embodiment of the retaining wall block of this invention.
Figure 2:
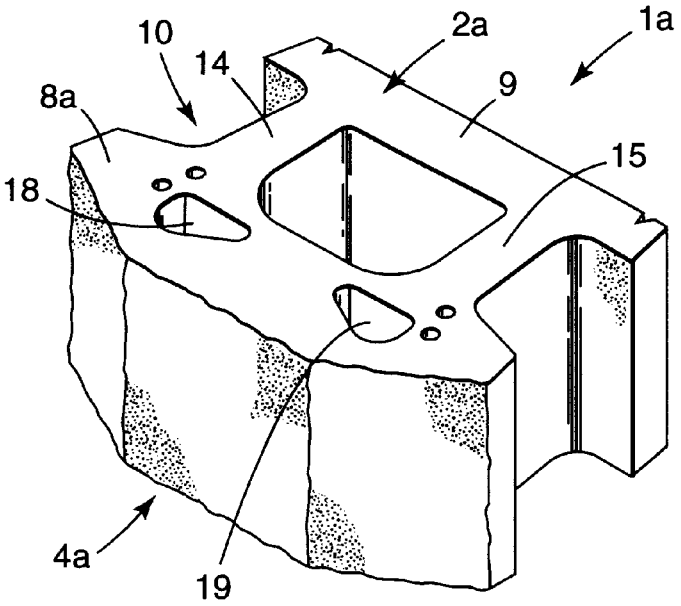
FIG. 2 is a perspective view from above and in front of the retaining wall block of FIG. 1.
Figure 3:
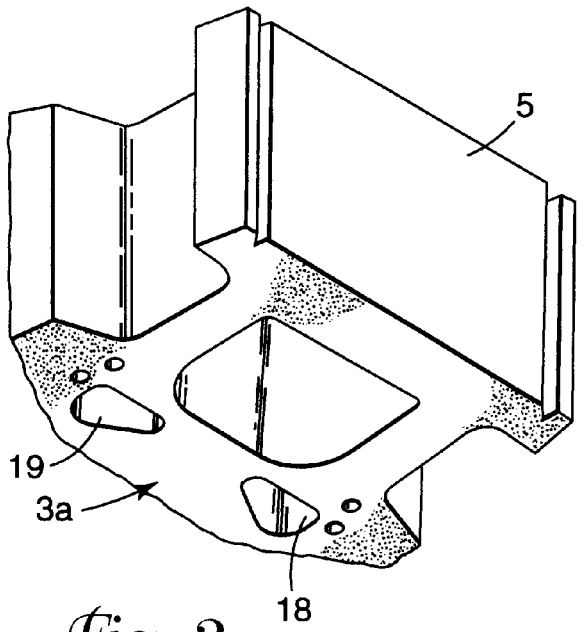
FIG. 3 is a perspective view from below and behind of the retaining wall block of FIG. 1.

A first embodiment of the retaining wall block is shown in FIGS. 1 to 3. Block 1*a* is made of a rugged, weather resistant material, preferably (and typically) zero-slump molded concrete. Other suitable materials include plastic, reinforced fibers, wood, metal and stone. Block 1*a* has parallel top face 2*a* and bottom face 3*a,* front face 4*a,* rear face 5 and first and second side wall faces 6*a* and 7*a*. Front face 4*a* and rear face 5 each extend from top face 2*a* to bottom face 3*a*. Side wall faces 6*a* and 7*a* extend from top face 2*a* to bottom face 3*a* and from front face 4*a* to rear face 5. Block 1*a* is generally symmetrical about vertical plane of symmetry S. Also, as indicated in FIGS. 2 and 3, the bottom and top face of block 1*a* are the same and therefore either face can be the upper or lower surface when constructing a retaining wall.

The front face of block 1*a* is formed of angled outer surfaces 26 and 27 and central surface 28*a* disposed perpendicular to plane of symmetry S so as to provide for a multi-faceted front face on a wall constructed of the blocks.

Block 1*a* comprises body portion 8*a,* head portion 9 and neck portion 10 connecting body portion 8*a* and head portion 9. Front face 4*a* forms part of body portion 8*a,* while rear face 5 forms part of head portion 9. The body, head and neck portions 8*a,* 9, and 10 each extend between top and bottom faces 2*a* and 3*a* and between first and second side wall faces 6*a* and 7*a*. Side wall faces 6*a* and 7*a* are thus of a compound shape and define side voids 11 and 12 between body and head portions 8*a* and 9 either side of neck portion 10 as a result of the reduced width of neck portion 10 compared to that of body and head portions 8*a* and 9.

Angled outer surfaces 26 and 27 of front face 4*a* join side portions 35*a* and 36*a,* respectively, of side walls 6*a* and 7*a* thus forming comers 20*a* and 21*a*. Side portions 35*a* and 36*a* are also angled (i.e., converging toward the rear face) extending from the front face inwardly toward the rear face. Side portions 35*a* and 36*a* adjoin shoulders 39 and 40 of body portion 8*a*.

Notches 33 and 34 are provided along rear face 5 to allow the user to remove ears 31 and 32 by conventional splitting techniques. Removal of a portion of the rear face may be desirable in the formation of curved walls. Preferably, side wall portions 43 and 45 of side walls 6*a* and 7*a* are substantially perpendicular to the rear face 5, although the side wall portions may angle toward the rear face.

Opening or core 13 extends through neck portion 10 from top face 2*a* to bottom face 3*a*. Core 13 divides neck portion 10 into first and second neck wall members 14 and 15 which extend to the rear of the block (i.e., from body portion 8*a* to head portion 9). Core 13 and side voids 11 and 12 also reduce the weight of block 1*a*. A lower weight block is both a manufacturing advantage and an advantage when constructing a wall from the blocks.

Neck wall members 14 and 15 have outside lateral surfaces 24 and 25, respectively, that coincide with and define planes 55*a* and 57*a*. Planes 55*a* and 57*a* intersect with body portion 8*a* of the block thus defining corner segments 56*a* and 58*a*. These corner segments are subject to greater breakage and damage during manufacture, transport, and construction of retaining walls. Therefore, in the blocks of this invention, the pin receiving cavities are located entirely or at least substantially outside these corner segments. It has been found that this is an advantage in reducing breakage and damage to the blocks.

First and second pin receiving cavities 18 and 19 are disposed in body portion 8*a* and extend between top and bottom faces 2*a* and 3*a,* i.e., opening onto both top and bottom surfaces. Cavities 18 and 19 are referred to as "kidney shaped", that is, the cavities are curvilinear, having no sharp angles. The shape and size and location of the cavities are selected to maximize the strength of the block while at the same time, since they extend between the top and bottom surfaces, the block weight is minimized. The cavities may be tapered, for ease of manufacturing. That is, the area of the kidney shape in the top of the block preferably is slightly larger than the area of the kidney shape in the bottom of the block. Cavities 18 and 19 each have rear walls 22 and 23 that are substantially perpendicular to the plane of symmetry. Cavities 18 and 19 are positioned on the block such that they lie inside (i.e., toward the center of the block) planes 55*a* and 57*a,* and no portion of them is in corner segments 56*a* and 58*a,* respectively.

Pin receiving cavities 18 and 19 preferably extend all the way through the blocks. This is an advantage because the blocks are formed, unmolded, and used with the top surface facing up. Therefore, they do not need to be flipped over by an installer when a retaining wall is built. Further, installation is simplified since the installer can see the pin in a block in a lower course through the pin receiving cavity of a block in an upper course, thus making alignment easier.

Also disposed in body portion 8*a* are first and second pin holes 16 and 17 adjacent cavities 18 and 19, respectively, positioned away from the cavities toward side portions 35 and 36. The first and second pin holes are also slightly to the rear of the pin receiving cavities. The location of the pin holes relative to the cavities is discussed further below. An optional second pair of pin holes, i.e., third and fourth pin holes 29 and 30, is also illustrated in block 1*a*. This optional set of pin holes is located in a rearward direction and toward the core relative to the first set of pin holes and provides a way to offset stacking blocks, as described further below.

Pin holes typically extend through to bottom face 3*a* and are sized to receive pin 50. In forming a wall from the blocks, a pin in a pin hole is installed and projects from the top face of an underlying block typically by approximately 20 mm to engage the pin receiving cavity of an overlying block. In this manner, the pin in a block on a lower course of blocks in a wall engages a pin receiving cavity of a block in an upper course. This results in an interlocking of the blocks with a predetermined setback in the same general manner as that described in the earlier Forsberg patent, U.S. Pat. No. Re. 34,134 and as described further below.

Referring to FIGS. 1 to 4, the preferred block has a pair of third and fourth pin holes 29 and 30 disposed toward the rear or head portion and toward core 13 relative to first and second pin holes 16 and 17. Pin holes 29 and 30 provide increased setback as compared to that provided by first and second pin holes 16 and 17. Further pin holes can be provided, if desired, so as to provide for further choices of predetermined setback.

Thought the blocks illustrated in the Figures may have various dimensions, block 1*a* illustrated in FIGS. 1, 2 and 3 typically has a thickness (i.e., the distance between surfaces 2*a* and 3*a*) of about 8 inches (20.3 cm) and a width (i.e., the distance from corner 20*a* to corner 21*a*) of about 18 inches (45.7 cm).

Figure 4:
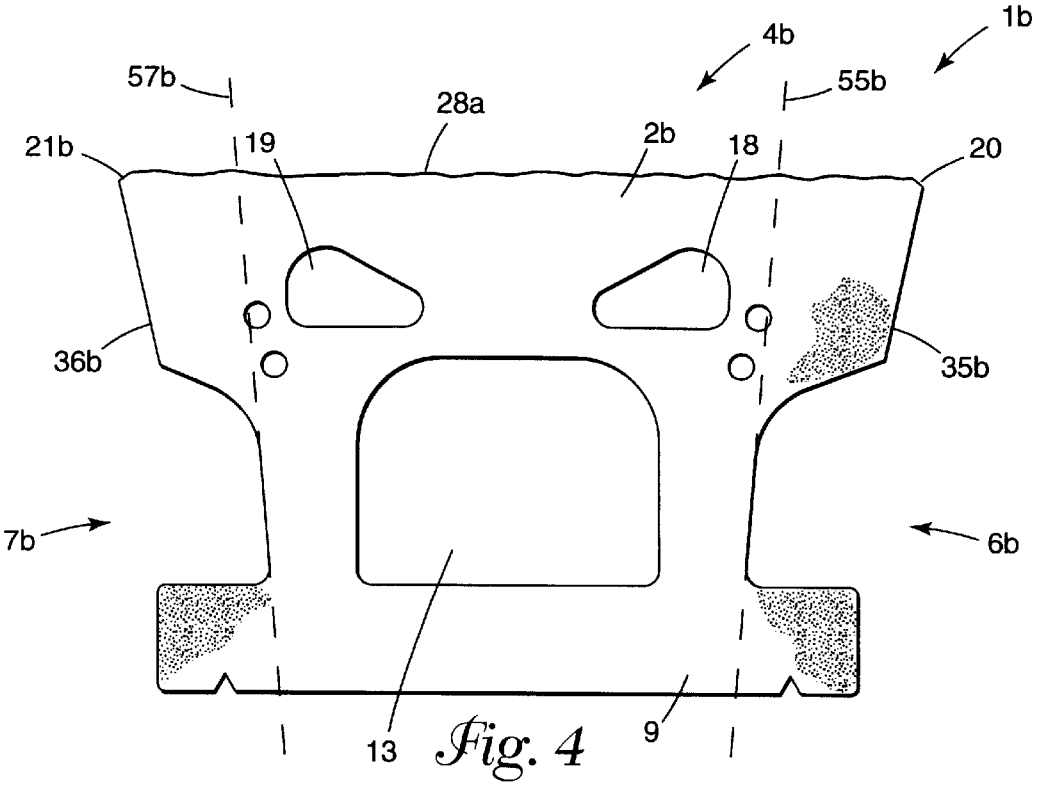
FIG. 4 is a top view of a second embodiment of the retaining wall block of this invention.

FIG. 4 illustrates a second embodiment of the retaining wall block of this invention. Block 1*b* of FIG. 4 is substantially similar to the block of FIG. 1, except that front face 4*b* of block 1*b* is straight, having no angled portion. Front face 4*b* of block 1*b* adjoins side wall surfaces 35*b* and 36*b* at corners 20*b* and 21*b*. The shape and features of side walls 6*b* and 7*b* are the same in block 1*b* as in block 1*a*. FIG. 4 illustrates that pin receiving cavities 18 and 19 lie to the inside of planes 55*b* and 57*b,* respectively, so that corner segments 56*b* and 58*b* have no penetrations therein.

Figure 5:
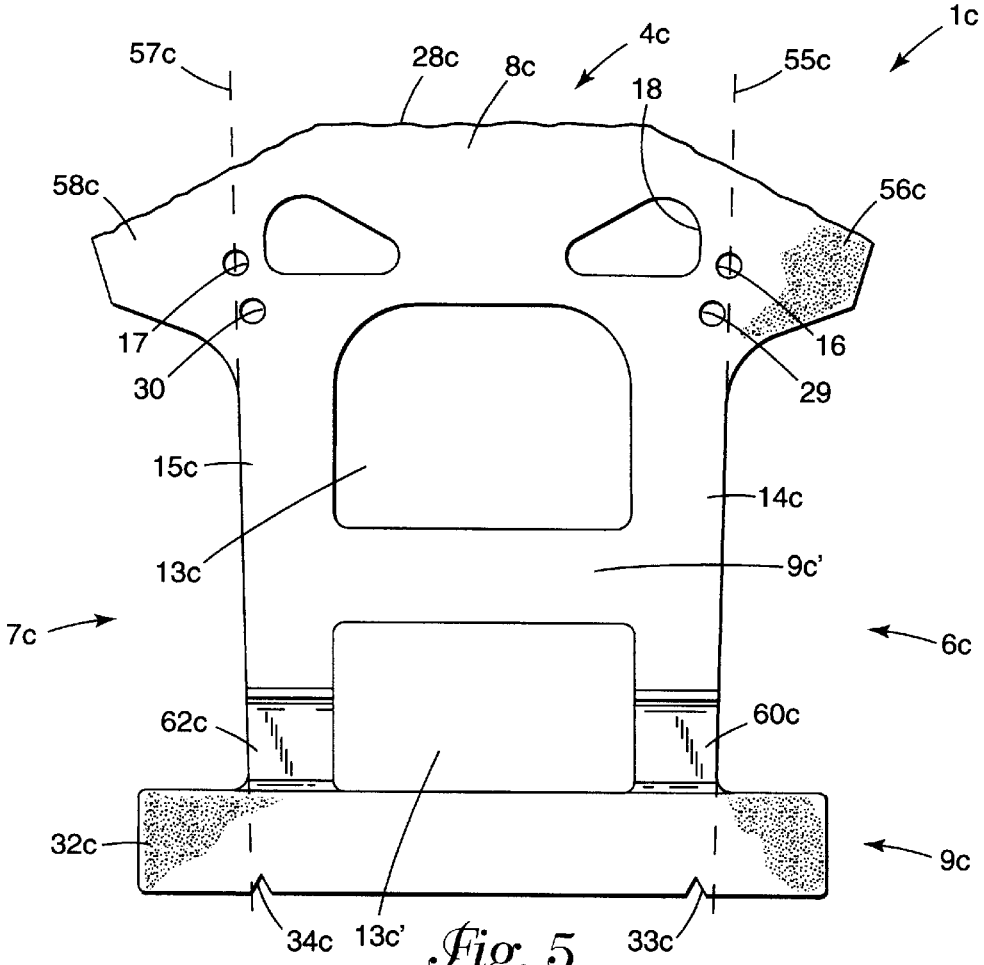
FIG. 5 is a top view of a third embodiment of the retaining wall block of this invention.

FIG. 5 illustrates a third embodiment of the block. Block 1*c* of FIG. 5 has a body portion substantially similar to block 1*a* of FIG. 1, being provided with pin holes 16, 17, 29 and 30, pin receiving cavities 18 and 19, and first core 13*c* in substantially the same arrangement as that of block 1*a*. Neck wall members 14*c* and 15*c* extend rearward of head portion 9*c′* and join rear head portion 9*c*. Second core 13*c′* is formed and bounded by neck wall members 14*c* and 15*c,* head portion 9*c′,* and rear head portion 9*c*. In addition, neck wall members 14*c* and 15*c* are provided with slots 60*c* and 62*c,* configured to receive a connecting member, described further below. Rear head portion 9*c* is also provided with notches 33*c* and 34*c* so that ears 31*c* and 32*c* can be removed if desired. Pin receiving cavities 18 and 19 are located toward the center of the block within planes 55*c* and 57*c*.

Figure 6:
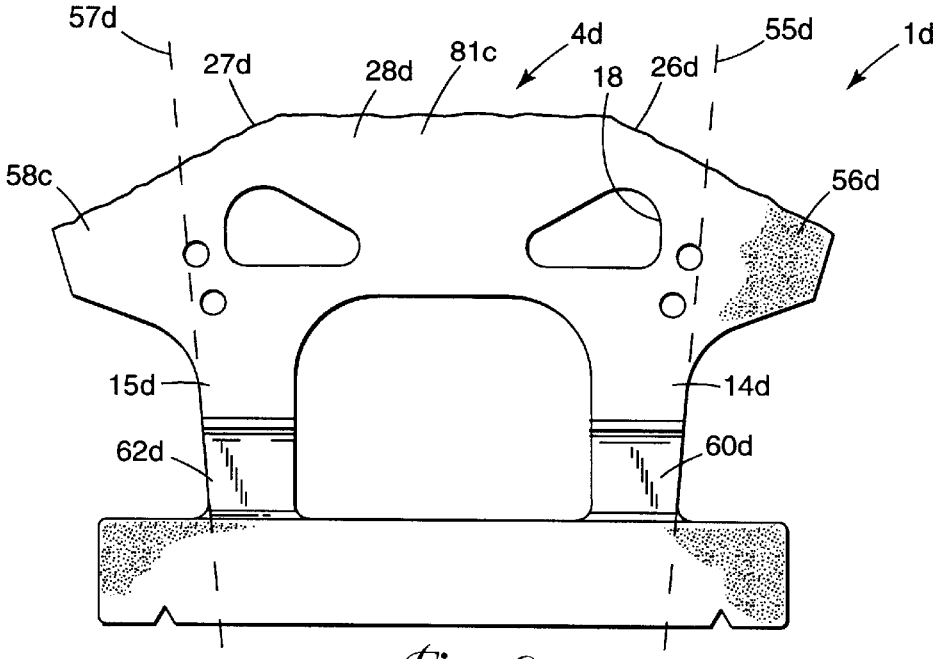
FIG. 6 is a top view of a fourth embodiment of the retaining wall block of this invention.

FIG. 6 illustrates a fourth embodiment of the retaining wall block of this invention. Block 1*d* of FIG. 6 is substantially similar to block 1*a* of FIG. 1, except that top surface 4*d* of the block is provided with slots 60*d* and 62*d* at the rear of the neck wall members 14*d* and 15*d*. Slots 60*d* and 62*d* have a width and depth sufficient to receive a connecting member, as described further below. FIG. 6 also illustrates that corner segments 56*d* and 58*d* have no portion of the pin receiving cavities in them.

Figure 7:
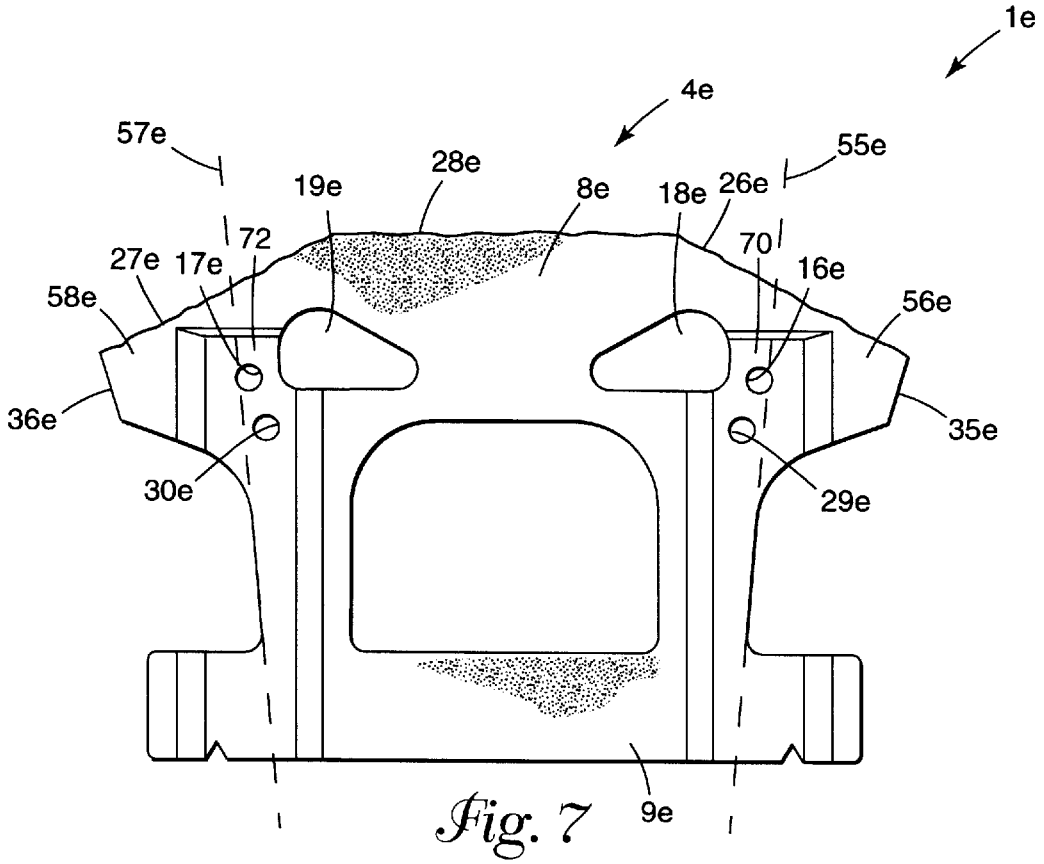
FIG. 7 is a top view of a fifth embodiment of the retaining wall block of this invention.

FIG. 7 shows a fifth embodiment, block 1*e*, substantially similar to block 1*a* of FIG. 1, except that top surface 8*e* does not have the optional pin holes (29 and 30). Channels 70 and 72 are parallel to the plane of symmetry and are disposed symmetrically about pin holes 16*e* and 17*e*, respectively. The channels are adapted to receive a connector plate that has a hole sized and positioned so that a pin through the plate and into pin hole 16*e* or 17*e* holds the connector plate in place. The use of the connector plate is described further below. Pin receiving cavities 18*e* and 19*e* lie away from the corner segments as defined by the intersection of planes 55*e* and 57*e*, respectively, with body portion 8*e*.

Figure 8:
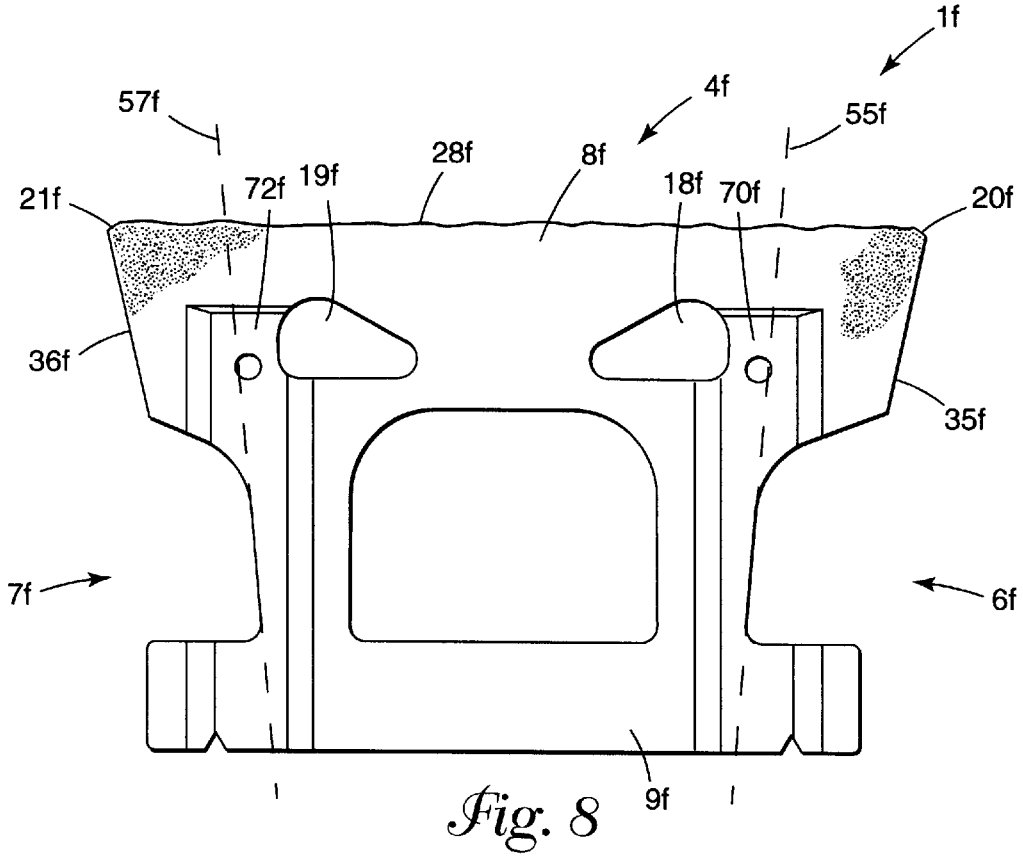
FIG. 8 is a top view of a sixth embodiment of the retaining wall block of this invention.

FIG. 8 illustrates a sixth embodiment, block 1*f*, substantially similar to the block of FIG. 7, except that front surface 28*f* is straight, having no angled surfaces (such as the front surface shown for the block in FIG. 4). Front surface 28*f* joins side wall surfaces 35*f* and 36*f* at corners 20*f* and 21*f*, respectively. Block 1*f* further comprises channels 70*f* and 72*f*, disposed in top 8*f*, similar as described above for the block of FIG. 5. Pin receiving cavities 18*f* and 19*f* lie away from the corner segments as defined by the intersection of planes 55*f* and 57*f*, respectively, with body portion 8*f*.

Figure 13:
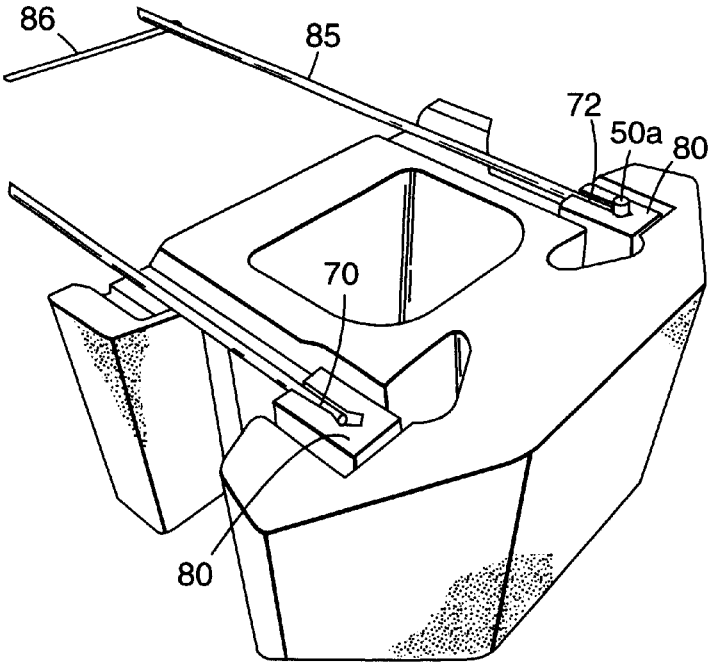
FIG. 13 is a perspective view of the block of FIG. 5 with tensor connectors in place.

For either embodiment shown in FIGS. 7 and 8, the function of connector plate 80 is illustrated in FIG. 13. Connector plate 80 affixes to steel rod 85 (itself affixed to one or more cross-rods 86) and provides reinforcement for the earth and/or a geogrid behind the retaining wall.

Figure 9A:
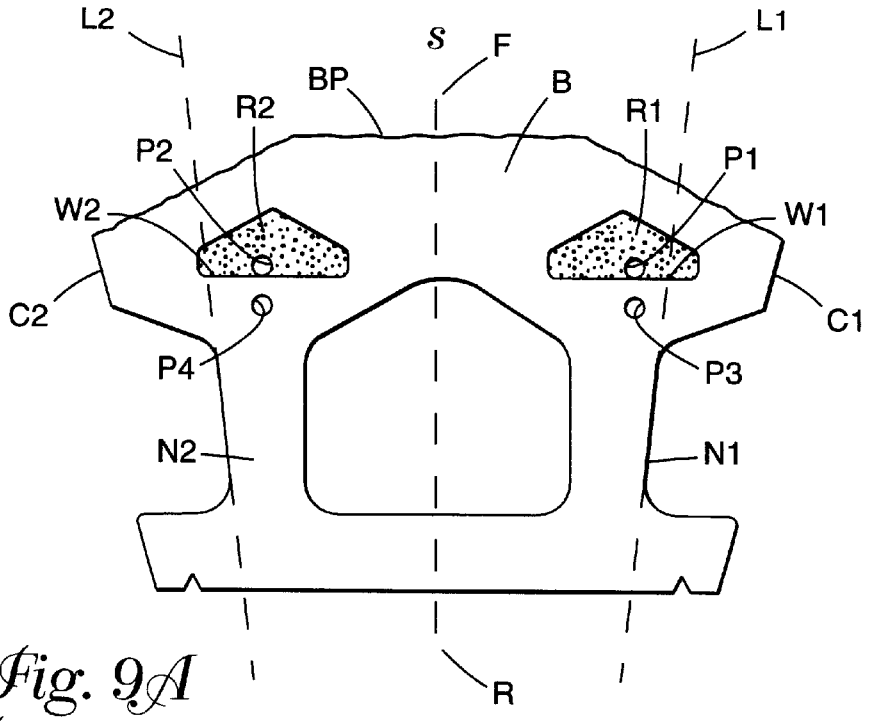
Fig. 9A (Prior Art)
FIG. 9A is a bottom view of a Prior Art block.

FIG. 9A illustrates a Prior Art block, showing a bottom view of the block. This block is similar to the block shown in FIG. 1, having body portion BP, front face F, rear face R, and neck wall members N1 and N2. However, the placement and shape of the pin receiving cavities and the placement of the pin holes is different. In addition, the pin receiving cavities do not pass through the thickness of the block, but are located on bottom B of the block. Pin receiving cavities R1 and R2 are disposed symmetrically on the block and toward front face F. Cavities R1 and R2 each have rear wall W1 and W2, respectively, which extend generally perpendicularly to a plane of symmetry S. Pin receiving cavities R1 and R2 are positioned generally symmetrically with respect to neck wall members N1 and N2. Pin receiving holes P1 and P3 (and P2 and P4) are aligned in a plane parallel to the plane of symmetry. A portion of the pin receiving cavity is in corner segment C1 or C2, as defined by the intersection of plane L1 or L2, respectively, with body portion BP. In addition, the pin-holes are centered on the block with respect to the pin receiving cavities.

Figure 9B:
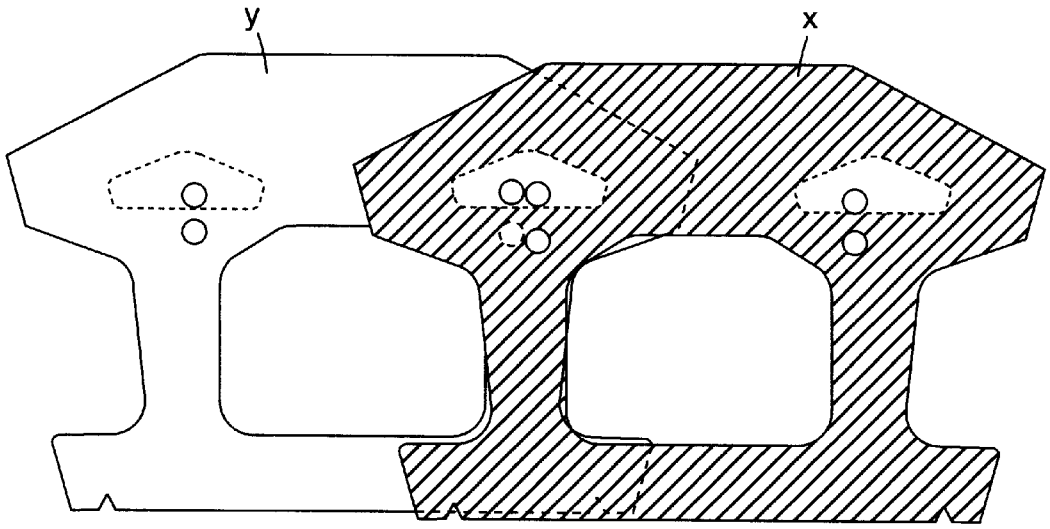
Fig. 9B (Prior Art)
FIG. 9B is a top view of two Prior Art blocks in a running bond arrangement.

FIG. 9B shows a top view of two Prior Art blocks in a running bond arrangement. Top block X overlaps bottom block Y. Pin receiving cavities R1 and R2, on the bottom of the block, align with pin holes P1 and P2.

Figure 10:
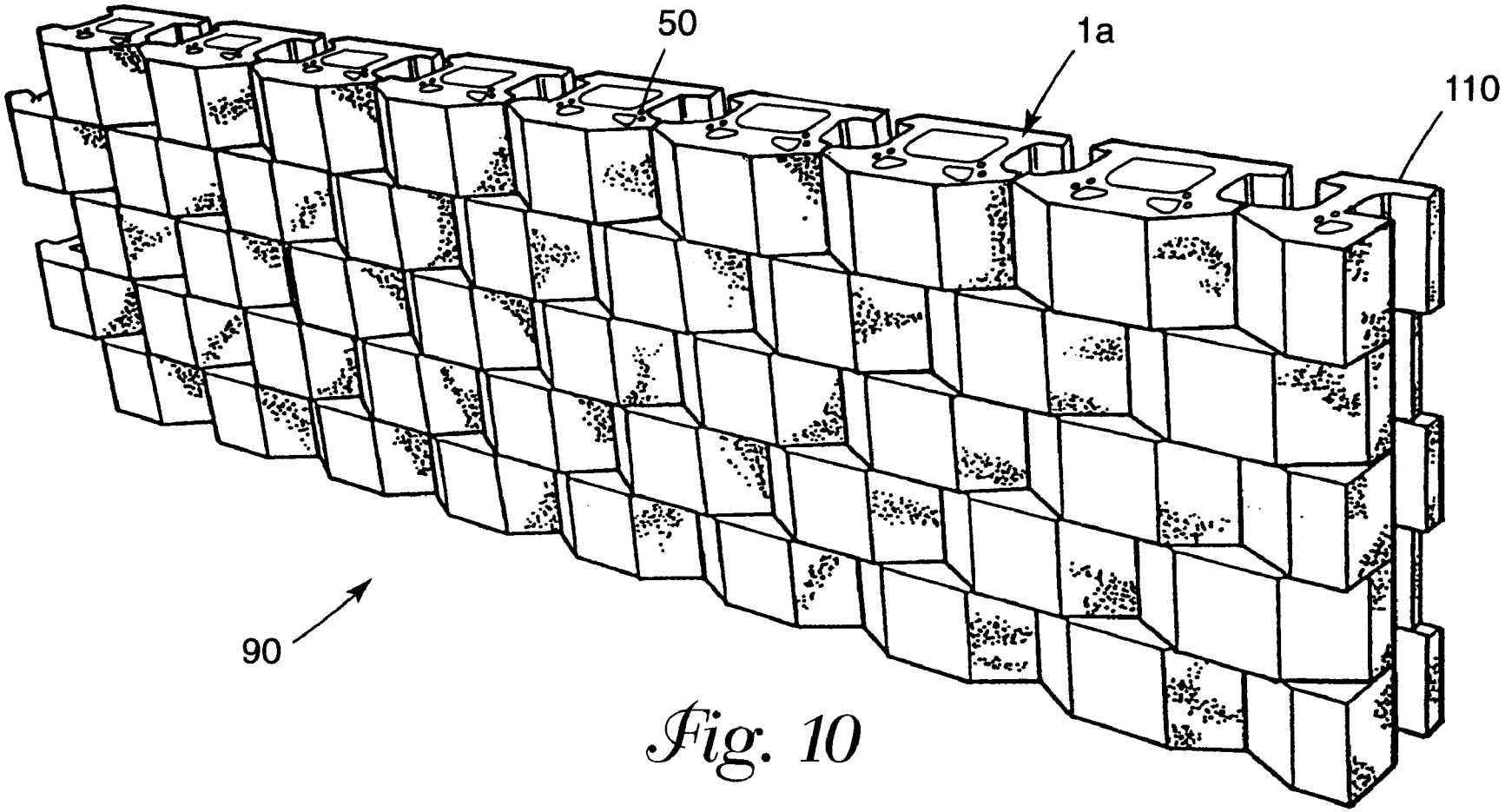
FIG. 10 is a perspective view of a retaining wall of the block of FIG. 1.
Figure 11:
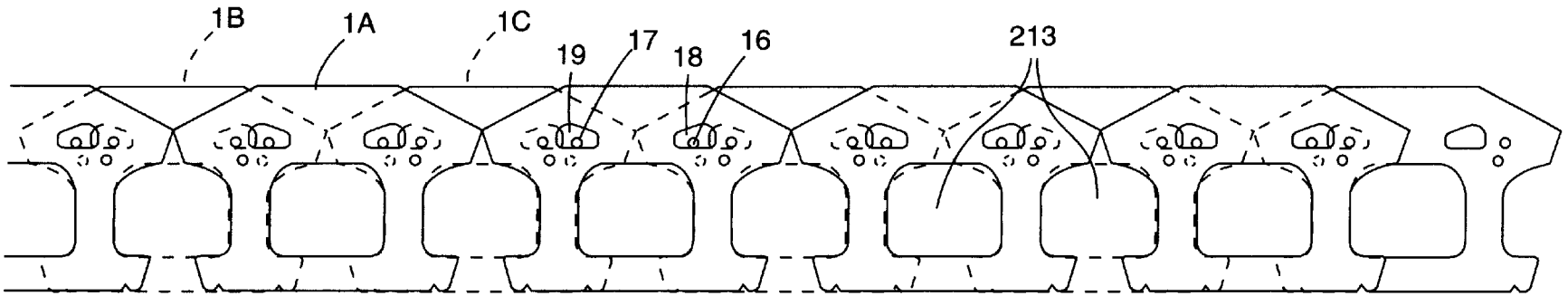
FIG. 11 is a top plan view of the retaining wall of FIG. 10.

FIG. 10 shows retaining wall 90 made from the blocks of this invention and FIG. 11 shows a plan view of such a wall. Blocks 1*a* (as shown in FIG. 1) are laid in a running bond pattern with first block 1A on top of second and third blocks 1B, 1C, for example. Pins 50 are placed in first and second pin receiving holes 16 and 17 of the block on the bottom and respectively engage first and second pin receiving cavities 18 and 19 of the blocks on the top so as to provide the interlock between the blocks with the predetermined setback.

FIG. 11 also shows that first and second neck wall members 14 and 15 substantially vertically align with the neck wall members of blocks in adjacent (upper or lower) courses when laid in a running bond pattern as shown in the wall of FIG. 10 and its plan view in FIG. 11. Such vertical alignment maximizes the area of the core that can be filled.

First and second pin receiving cavities 18 and 19 each have rear wall 22 and 23, respectively, extending generally perpendicularly to plane of symmetry S. Pin receiving cavity rear walls 22 and 23 are approximately 76 mm (3 inches) long. When first block 1A of FIG. 11 is placed with its pin receiving cavities 18 and 19 over pins 50 protruding from pin holes 17 and 16 of second and third blocks 1B and 1C, first block 1A is manually pushed forward until pins 50 engage pin receiving cavity rear walls 22 and 23. This engagement serves to interlock the blocks in a wall. The shape of the pin receiving cavities allows some lateral adjustment of the blocks.

If set back is desired, pins are placed in optional pin receiving holes 29 and 30. The amount of set back from one course of blocks to the next is determined by the distance between the pin receiving cavity rear walls 22 and 23 and the rear edge of pin receiving holes 29 and 30. This setback distance can thus be predetermined through the design of the block, and will typically be of the order of 32 mm (1.25 inch) for a block such as that depicted which has a height of 200 mm (7.9 inches), providing for a setback of approximately 12.5% or 1:8. Of course the amount of set back could be varied by placing pin holes further rearward.

Straight retaining wall 90 is constructed from the blocks utilizing first and second pin holes 16 and 17 to interlock the blocks is depicted in FIGS. 10 and 11. As can be seen, use of first and second pin holes 16 and 17 with pin 50, provides near vertical setback between courses resulting in a vertical wall 90. Half blocks 110 may be used at the lateral ends of wall 90 in alternate courses to finish the wall in the usual manner if the wall end abuts a vertical surface. Half blocks may be field cut using a masonry saw or cut at the factory. FIG. 10 clearly depicts how alignment of the neck wall members of vertically adjacent blocks and consequent alignment of cores 13 with side voids 11 and 12 of vertically adjacent blocks produces continuous cavities 213 extending through the height of wall 90. Gapping blocks are typically used to finish the top of the wall.

The blocks of this invention are suitable for forming straight, curved or serpentine walls. To provide for convex faced curved walls and serpentine walls, portions of the side wall faces are generally angled from front face 4 to rear face 5, such that the block is wider at front face 4 between corners 20 and 21 (as shown in FIGS. 1 to 3, for example) than at rear face 5. This enables the blocks to be placed in a convex curve in the usual manner without interference between the head portion 9 of laterally adjacent blocks. To provide for increased curvature of a convex-curved section of wall, head portion 9 is provided with first and second ears 31 and 32 extending laterally beyond first and second neck wall members 14 and 15, respectively. First and second ears 31 and 32 can be knocked off head portion 9 by splitting techniques as a result of the notches 33 and 34

The retaining wall can alternatively be reinforced with the use of a reinforcing geogrid tie-back (referred to as "geogrid") in a similar manner to that disclosed in Forsberg, U.S. Pat. No. Re. 34,134 and illustrated in FIG. 12. Geogrid 92 is a generally flat sheet of material arranged as a grid, typically formed of high strength polymeric material (e.g., polyester, polyaramid, polypropylene) or of steel, which is placed between courses of blocks 1 in the retaining wall and extends rearwardly into the fill behind wall 90 to anchor the wall against forces tending to topple the wall forward. Pins 50 interlocking the blocks of adjacent courses are passed through apertures of geogrid 92 so as to assist fixing of geogrid 92 between the courses. The configuration of the preferred block which ensures neck wall members 14 and 15 of interlocked blocks overlap in line with pins 50 helps resist pull-out of geogrid 92.

Figure 12:
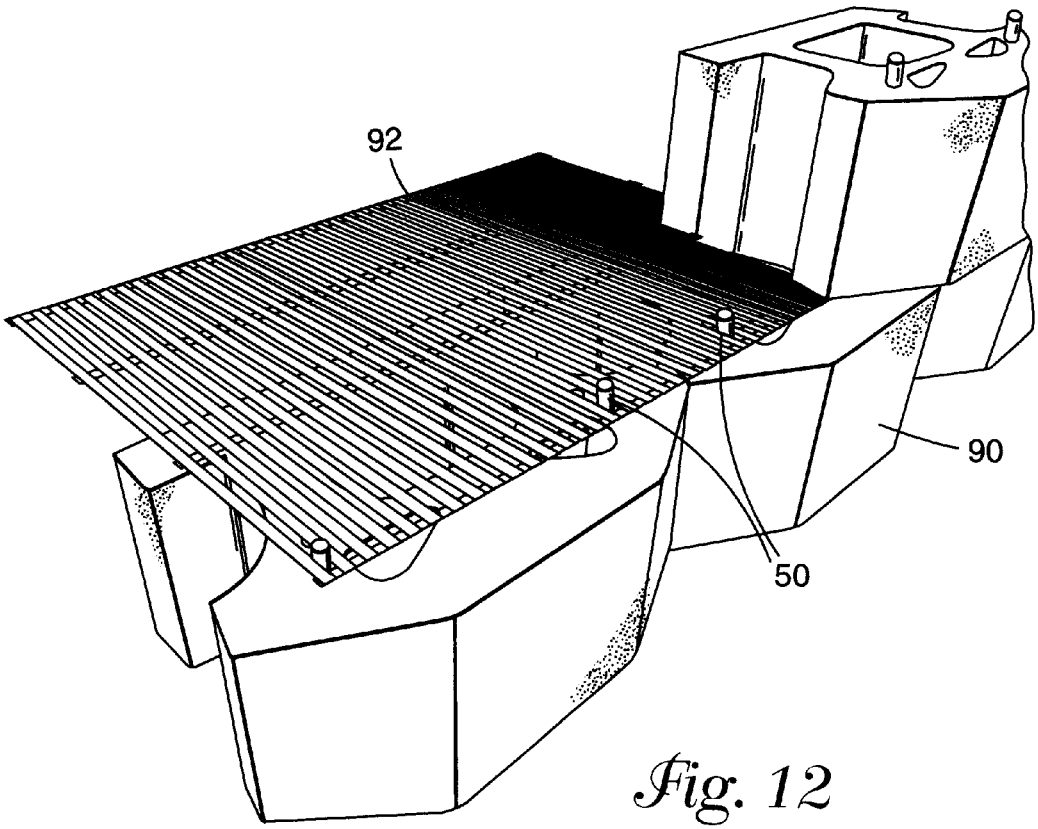
FIG. 12 is a perspective view of a section of a retaining wall with a geogrid in place.

FIG. 12 illustrates geogrid tieback 92 in a cut-away illustration of wall 90. Tieback 92 is between courses of blocks and positioned over pins 50 that are inserted into pin holes 16 and 17.

FIG. 13 illustrates a steel reinforcement grid comprising rods 85 and cross bar 86. Rods 85 are placed in grooves 70 and 72 (as shown in FIG. 7 for block 1*e*) and held in place by connector plate 80. Steel pins 50*a* hold rods 85 in place.

Figure 14A:
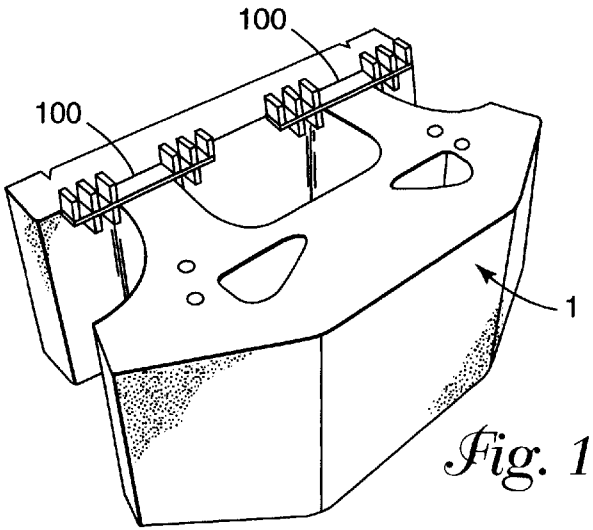
FIG. 14A illustrates the block of FIG. 1 with connectors in place.
Figure 14B:
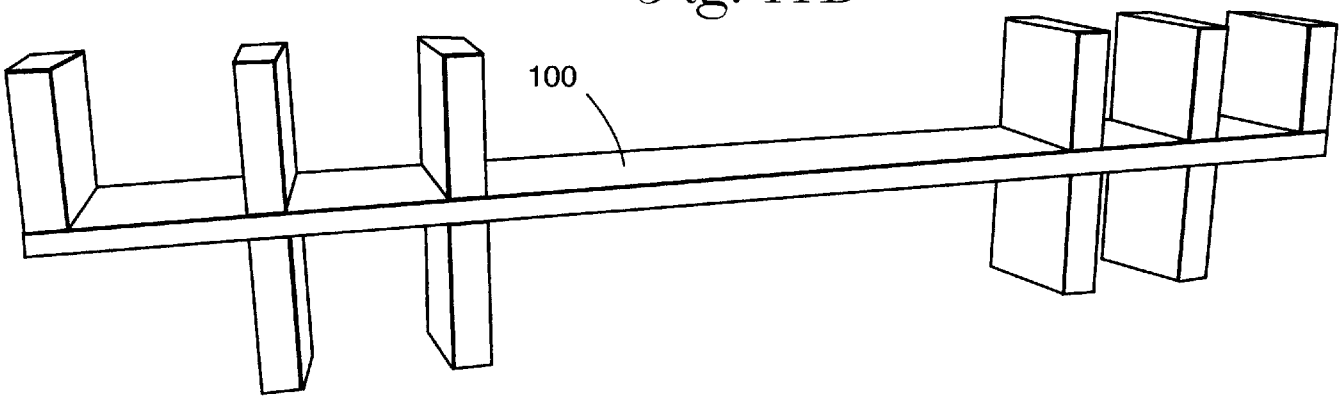
FIG. 14B illustrates the connector of FIG. 14A.
Figure 15A:
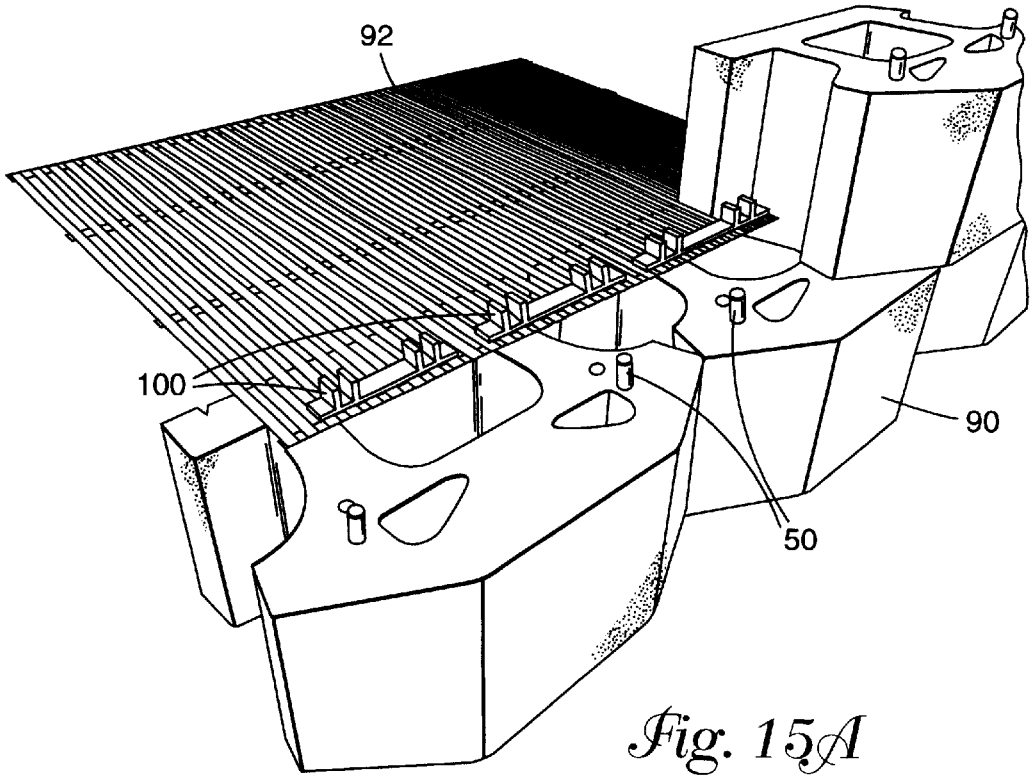
FIG. 15A is a perspective view of a section of a retaining wall with a geogrid in place.
Figure 15B:
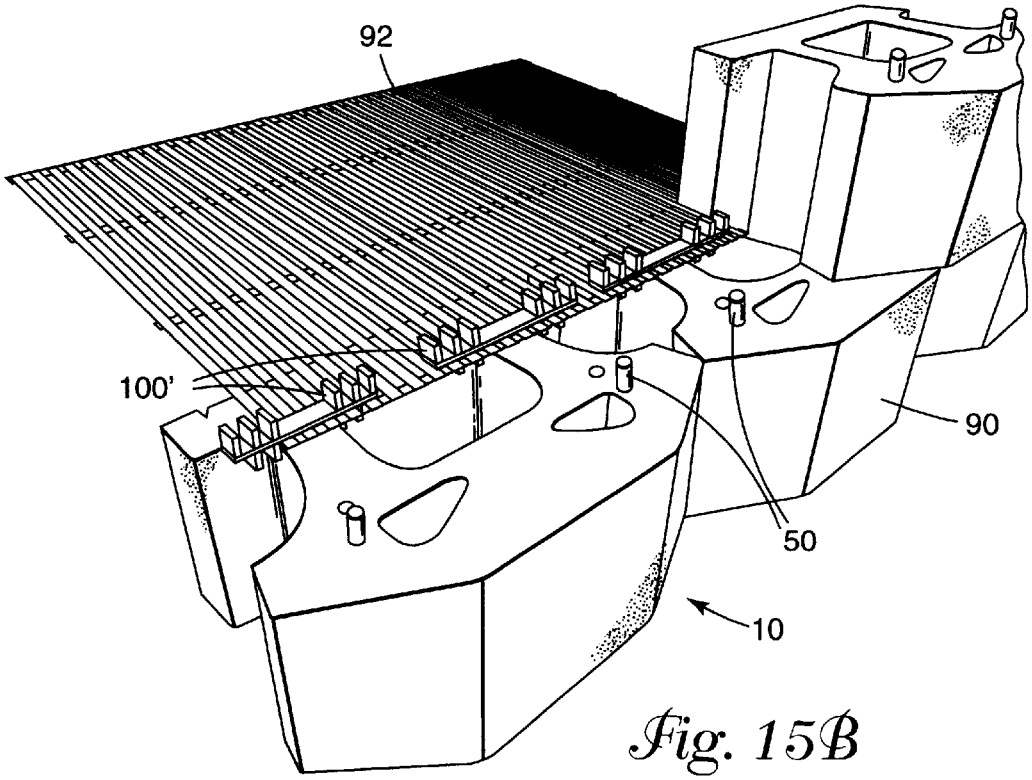
FIG. 15B is a perspective view of a section of a retaining wall with a connector bar at the top of the block and a geogrid held by the connector bar.

FIG. 14A illustrates connectors 100 positioned in block 1*a*. FIG. 14B is a detailed view of connector 100. The connectors hold a geogrid in place. This is in contrast to the geogrid of FIG. 12, which is held in place by means of the retaining pins 50. FIGS. 15A and 15B illustrate two ways in which to use a connector and geogrid. In FIG. 15A, the geogrid is laid in place between courses of blocks in wall 90 (a portion of which is shown here), and connector 100 is inserted into the grid from the top. In FIG. 15B, connectors 100 are shown spanning neck wall members (i.e., 14, 15) of the block. Connectors 100 lie against the back surface of block core 13. Tension can thus be applied to the geogrid without dislodging or displacing the connectors.

Blocks of this invention are typically manufactured of concrete and cast in a high-speed masonry block machine. Pin receiving cavities 18 and 19, neck opening 13 and pin holes 16, 17, 29 and 30 are formed using cores. The pin holes extend through the depth of the block to enable the pin-hole forming cores to extend to the top face (which forms the bottom surface during casting). The cores may be tapered so that the bore that is formed is wider at the top of the block than at the bottom of the block. Tapering is done for manufacturing ease. Typically, blocks are formed as mirror image pairs joined at front face 4 which are then subsequently split using a block splitter, as known in the art, to provide a rough appearing front surface (e.g., 28*a* to 28*f* in FIGS. 1 to 3 and 5 to 7, respectively; and 4*b* and 4*f* in FIGS. 4 and 8, respectively) on the split blocks. Alternatively, other methods may be utilized to form a variety of front face surface appearances. Such methods are well known in the art.

Figure 16:
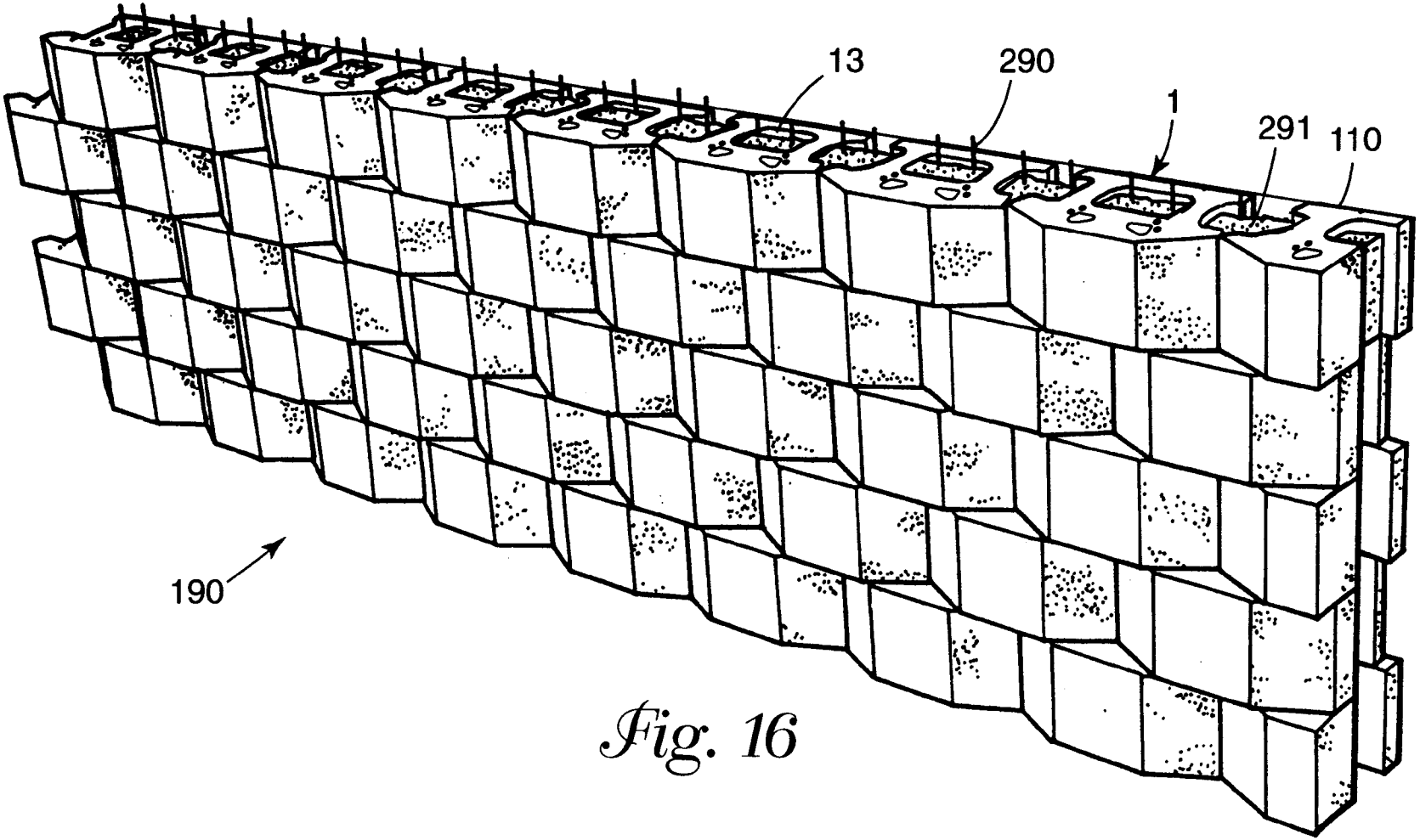
FIG. 16 is a perspective view of a retaining wall similar to that of FIG. 10 but reinforced with rebar and grout.

A retaining wall formed of courses of blocks of the preferred embodiment can be reinforced with the use of rebar and grout. An example of such reinforced wall 190 is depicted in FIG. 16. Lengths of rebar 290 are inserted into at least one of the continuous cavities 213 defined by neck openings 13 and vertically adjacent side voids 11 and 12 of blocks in alternate courses. Cavities 213 are then filled with grout 291 to encase rebar 290. This form of reinforcing is particularly applicable to vertical or minimum setback walls with blocks interlocked using third and fourth pin holes 29 and 30, but can also be used for larger setback walls, where cavities 213 defined in the wall will still be continuous but will be inclined at an angle equal to the setback angle of the wall. Alternatively, the wall may be reinforced by placing threaded rods through the cavities and using conventional post-tension techniques.

Figure 17:
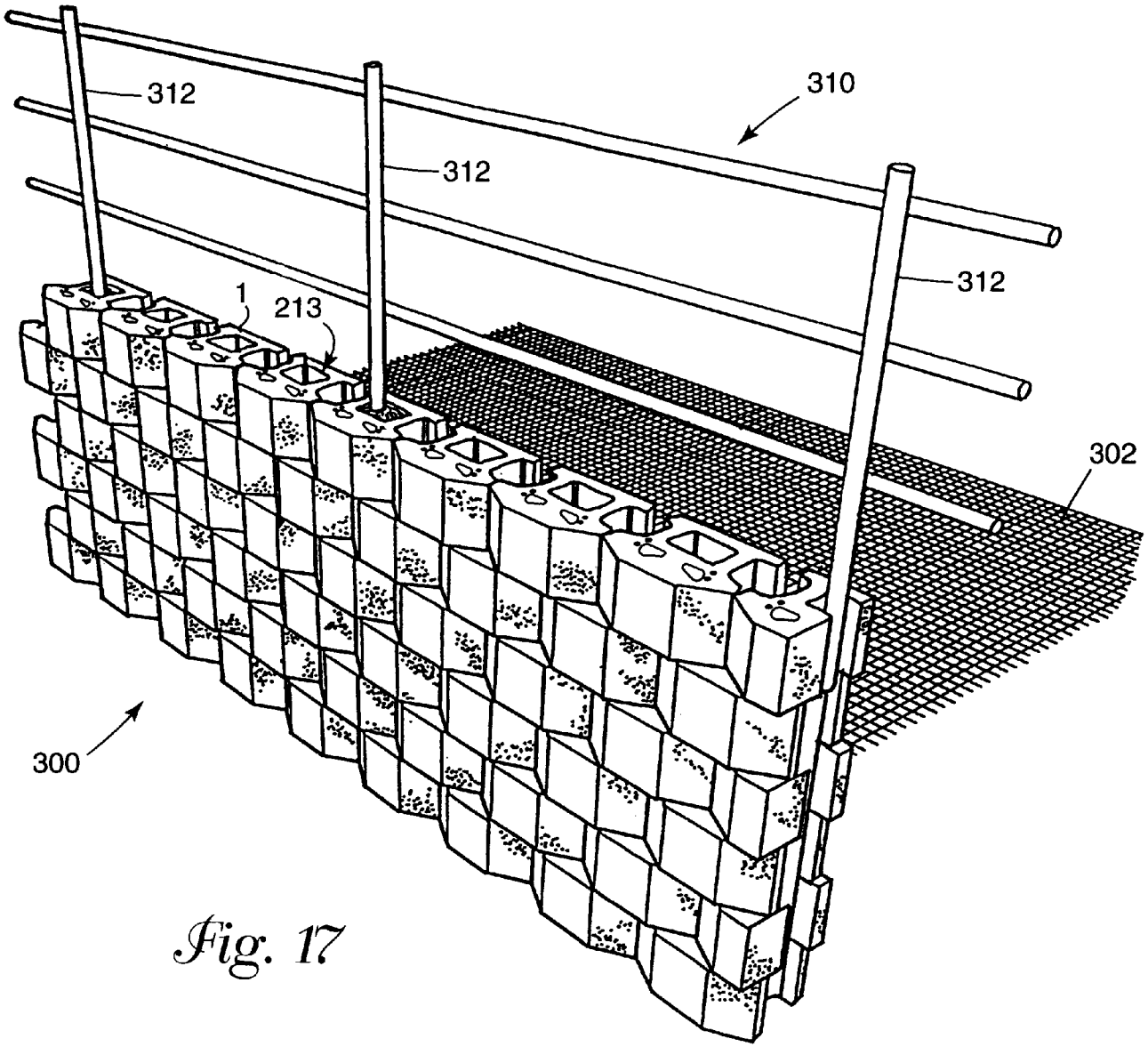
FIG. 17 is a perspective view of a retaining wall similar to that of FIG. 10 but incorporating a geogrid tie-back and fence posts.

The retaining wall can alternatively be reinforced with the use of a reinforcing geogrid tie-back in a similar manner to that disclosed in Forsberg, U.S. Pat. No. Re. 34,134. Vertical retaining wall 300 depicting the use of such a tie-back 302 is shown in FIG. 17. Tie-back 302 is a generally flat sheet of material arranged as a grid, typically formed of high strength plastics material or steel, which is placed between courses of blocks 1 in the retaining wall and extends rearwardly into the fill behind wall 300 to anchor the wall against forces tending to topple the wall forward. Pins 50 interlocking the blocks of adjacent courses are passed through apertures of tie-back grid 302 so as to assist fixing of tie-back 302 between the courses. The configuration of the preferred block which ensures neck wall members 14 and 15 of interlocked blocks overlap in line with pins 50 helps resist pull-out of the tie-back reinforcement 302.

Figure 18:
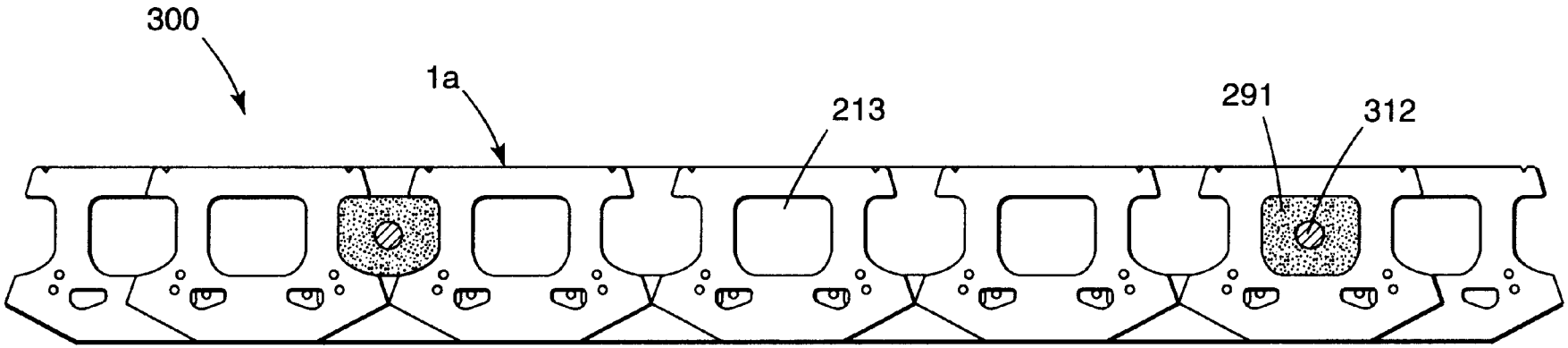
FIG. 18 is a top plan view of a retaining wall incorporating fence posts.

FIGS. 17 and 18 also depict the integration of fence posts 313 into the top of retaining wall 300. Posts 312 of fence 310, or of similar structures such as guardrails, can be inserted into cavities 213 formed by neck openings 13 and side voids 11 and 12 of the blocks of alternate courses and secured if necessary with grout 291 or other fill. A single sign post could also be secured to the wall in such a manner. Due to the relatively short embedment depth of the preferred embodiment, reinforcement of the structure is typically necessary when placing fence posts 312 in cavities 213. FIG. 17 depicts geogrid reinforcement for this purpose.

The blocks of this invention exhibit numerous advantages over prior art designs. First, because the pin receiving cavities are positioned so that they are located entirely out of the vulnerable corner segments of the block the strength of the block is maximized. Second, because they extend through the thickness of the block the weight of the block is minimized. Third, unlike prior art blocks made with the bottom surface facing up, the present blocks can be manufactured, loaded into a pallet, shipped and installed without ever flipping the blocks over. Fourth, orientation of the blocks during installation is simplified since the installer is able to see (through the pin receiving cavity) the pins in lower block courses which are to fit into the pin receiving cavities.

Although particular embodiments have been disclosed herein in detail, this has been done for purposes of illustration only, and is not intended to be limiting with respect to the scope of the appended claims, which follow. In particular, it is contemplated by the inventor that various substitutions, alterations, and modifications may be made to the invention without departing from the spirit and scope of the invention as defined by the claims. For instance, the choice of materials or variations in the shape or angles at which some of the surfaces intersect are believed to be a matter of routine for a person of ordinary skill in the art with knowledge of the embodiments disclosed herein.

What is claimed is:

1. A retaining wall block comprising:

a top surface;

a bottom surface substantially parallel to the top surface;

first and second side surfaces;

a front face;

a rear face, the front and rear faces, top and bottom surfaces and side surfaces defining a body portion including the front face, a head portion including the rear face, and a neck portion connecting the body portion and the head portion, the neck portion including a first portion of the first side surface and a first portion of the second side surface, the first portion of the first side surface lying substantially within a first plane, the first portion of the second side surface lying substantially within a second plane, the neck portion being configured such that intersections of the first and second planes with the body portion define first and second corner portions of the body portion, the body portion including first and second pin holes opening into the top surface and first and second pin receiving cavities extending though the body portion and opening into the top surface and the bottom surface, the pin receiving cavities being positioned such that no portion of the cavities lie within the first and second corner portions.

2. The retaining wall block of claim 1 wherein the neck portion includes an opening extending through the neck portion from the top surface to the bottom surface, the opening dividing the neck portion into first and second neck wall members extending rearwardly from the body portion to the head portion.

3. The retaining wall block of claim 1 wherein the body portion further comprises third and fourth pin holes opening onto the top surface.

4. The retaining wall block of claim 1 wherein the side wall faces taper from the front face to the rear face.

5. The retaining wall block of claim 1 wherein the head portion has first and second ears extending laterally beyond the first and second neck wall members, respectively, the first and second ears each being provided with a notch to enable the ears to be knocked off the head portion.

6. A retaining wall comprising at least one lower course and at least one upper course, each course comprising a plurality of blocks laid in a running bond pattern, each block having a top surface; a bottom surface substantially parallel to the top surface;

first and second side surfaces;

a front face;

and a rear face;

the front and rear faces, top and bottom surfaces and side surfaces defining a body portion including the front face, a head portion including the rear face, and a neck portion connecting the body portion and the head portion, the neck portion including a first portion of the first side surface and a first portion of the second side surface, the first portion of the first side surface lying substantially within a first plane, the first portion of the second side surface lying substantially within a second plane, the neck portion being configured such that intersections of the first and second planes with the body portion define first and second corner portions of the body portion, the body portion including first and second pin holes opening into the top surface and first and second pin receiving cavities extending through the body portion and opening into the top surface and the bottom surface, the pin receiving cavities being positioned such that no portion of the cavities lie within the first and second corner portions;

first and second pins disposed in the first and second pin holes, respectively, of a block in the lower course, the first pin having a first free end protruding beyond the top face of the block, the second pin having a second free end protruding beyond the top face of the block, the first free end being received in a pin receiving cavity of a first block in the upper course, the second free end being received in a pin receiving cavity of a second block in the upper course, a continuous cavity being defined by each opening of vertically aligned blocks in the upper course of the blocks communicating with side voids of vertically adjacent blocks in the lower course.

7. The retaining wall of claim 6 wherein the plurality of blocks are laid in a running bond pattern.

8. The retaining wall of claim 6 wherein the retaining wall is straight.

9. The retaining wall of claim 6 wherein the retaining wall is curved.

10. The retaining wall of claim 6 wherein the retaining wall is serpentine.

11. The retaining wall of claim 6 wherein the retaining wall further comprises rebar and grout, a length of the rebar passing through the continuous cavity, the rebar being secured in the continuous cavity with the grout.

12. The retaining wall of claim 6 wherein the retaining wall further comprises at least one post extending into the continuous cavity and protruding from the upper course, at least one post being secured in the cavity with grout.

13. The retaining wall of claim 6 wherein the retaining wall further comprises a geogrid tie-back disposed between the upper and lower courses.

14. The retaining wall of claim 13 wherein the geogrid tie-back has apertures and is secured with at least one of the first and second pins passing through the apertures of the geogrid.

15. The retaining wall of claim 8 wherein the retaining wall further comprises a pilaster formed of a column of the blocks set forward from the remainder of the wall.

16. The retaining wall of claim 6 wherein each block further comprises a groove coincident with the neck portion and adapted to receive a connector plate, the groove and the connector plate together providing a connection means for a reinforcement grid.

17. The retaining wall block of claim 1 further wherein the block is symmetrical about a vertical plane of symmetry and wherein the first and second pin receiving cavities each have a rear wall extending substantially perpendicularly to the plane of symmetry.

18. The retaining wall of claim 6 further wherein each block of the plurality of blocks is symmetrical about a vertical plane of symmetry and wherein the first and second pin receiving cavities each have a rear wall extending substantially perpendicularly to the plane of symmetry.

19. A retaining wall block for use in constructing a wall having at least first and second courses of blocks, a plurality of blocks in the first course being connected to blocks in the second course by use of pins, the wall blocks comprising:

a top surface;

a bottom surface substantially parallel to the top surface;

first and second side surfaces;

a front face; and a rear face, the front and rear faces, top and bottom surfaces and side surfaces defining a body portion including the front face, a head portion including the rear face, and a neck portion connecting the body portion and the head portion, the neck portion including a first portion of the first side surface and a first portion of the second side surface, the body portion including first and second pin holes opening into the top surface and first and second pin receiving cavities extending through the body portion and opening into the top surface and the bottom surface, the block being symmetrical about a vertical plane of symmetry, the first pin receiving cavity and the first pin hole each being disposed on a first side of the plane of symmetry, the second pin receiving cavity and the second pin hole being disposed on a second side of the plane of symmetry, the first pin hole being located nearer the first side surface than the first pin receiving cavity and the second pin hole being located nearer the second side surface than the second pin receiving cavity.

20. The retaining wall block of claim 19 wherein the first and second pin receiving cavities each have a rear wall extending substantially perpendicularly to the plane of symmetry.

21. A retaining wall block comprising:

a top surface;

a bottom surface substantially parallel to the top surface;

first and second side surfaces;

a front face;

a rear face, the front and rear faces, top and bottom surfaces and side surfaces defining a body portion including the front face, a head portion including the rear face, and a neck portion connecting the body portion and the head portion, the neck portion including a first portion of the first side surface and a first portion of the second side surface, the body portion including first and second pin holes opening into the top surface and first and second pin receiving cavities extending through the body portion and opening into the top surface and the bottom surface, the block being symmetrical about a vertical plane of symmetry, the first and second pin receiving cavities each having a rear wall extending substantially perpendicularly to the plane of symmetry.

* * * * *